US009711105B2

(12) United States Patent
Ochiai et al.

(10) Patent No.: US 9,711,105 B2
(45) **Date of Patent: *Jul. 18, 2017**

(54) GATE SIGNAL LINE DRIVING CIRCUIT FOR NOISE SUPPRESSION AND DISPLAY DEVICE

(71) Applicants: Japan Display Inc., Tokyo (JP); Panasonic Liquid Crystal Display Co., Ltd., Hyogo-ken (JP)

(72) Inventors: Takahiro Ochiai, Chiba (JP); Mitsuru Goto, Chiba (JP); Youzou Nakayasu, Mobara (JP); Yuki Okada, Tama (JP); Naoki Takada, Yokohama (JP)

(73) Assignees: Japan Display Inc., Tokyo (JP); Panasonic Liquid Crystal Display Co. Ltd., Hyogo-ken (JP)

( * ) Notice: Subject to any disclaimer, the term of this patent is extended or adjusted under 35 U.S.C. 154(b) by 342 days.

This patent is subject to a terminal disclaimer.

(21) Appl. No.: 14/478,130

(22) Filed: Sep. 5, 2014

(65) Prior Publication Data

US 2014/0375615 A1 Dec. 25, 2014

Related U.S. Application Data

(63) Continuation of application No. 12/785,800, filed on May 24, 2010, now Pat. No. 8,854,291.

(30) Foreign Application Priority Data

May 29, 2009 (JP) ..... 2009-131609

(51) Int. Cl.
*G09G 3/36* (2006.01)

(52) U.S. Cl.
CPC ..... *G09G 3/3696* (2013.01); *G09G 3/3674* (2013.01); *G09G 2300/0434* (2013.01)

(58) Field of Classification Search
USPC .... 345/55, 98–100, 87, 103; 326/62, 63, 80; 327/333
See application file for complete search history.

(56) References Cited

U.S. PATENT DOCUMENTS 6,845,140 B2 * 1/2005 Moon ..... G09G 3/3685 345/100
2005/0008114 A1 * 1/2005 Moon ..... G09G 3/3677 377/64

(Continued)

FOREIGN PATENT DOCUMENTS

JP 2005-134780 5/2005
JP 2007-095190 4/2007

(Continued)

*Primary Examiner* — Ram Mistry
(74) *Attorney, Agent, or Firm* — Typha IP LLC

(57) ABSTRACT

A gate signal line driving circuit which suppresses noises in a gate signal and a display device which uses the gate signal line driving circuit are provided. A first basic circuit provided to a gate signal line driving circuit includes a HIGH voltage applying switching element which applies a HIGH voltage to gate signal lines in response to a signal HIGH period, and a LOW voltage applying switching circuit which applies a LOW voltage to the gate signal lines in response to a signal LOW period. In response to a signal HIGH period, a switch of the LOW voltage applying switching circuit of the first basic circuit is turned off based on a signal applied to a switch of the HIGH voltage applying switching element of a second basic circuit which assumes a signal HIGH period earlier than the first basic circuit.

8 Claims, 11 Drawing Sheets

(56) References Cited

U.S. PATENT DOCUMENTS

| | | | |
|---|---|---|---|
| 2007/0070020 | A1 | 3/2007 | Edo et al. |
| 2007/0217564 | A1 | 9/2007 | Tobita |
| 2008/0258998 | A1 | 10/2008 | Miyake |

FOREIGN PATENT DOCUMENTS

| | | |
|---|---|---|
| JP | 2007-250052 | 9/2007 |
| JP | 2008-122939 | 5/2008 |

* cited by examiner

Vn
Vn+2
Vn+4
Vn+6
VGL
VGH
VST1
IN5
IN2
IN1
OUT2
IN3
OUT
120
IN6
IN4
113-1
113-2
113-3
113-4
113-5
113-6
113-7
113-8
T4AG
T3G
T5D
N1
VGL
T10G
VGH
TIG
Gn
T9G
Gn+1
Gn+2
Gn+3
Gn+4
Gn+5
Gn+6
Gn+7
VST2
Vn+1
Vn+3
Vn+5
Vn+7

GATE SIGNAL LINE DRIVING CIRCUIT FOR NOISE SUPPRESSION AND DISPLAY DEVICE

CROSS-REFERENCE TO RELATED APPLICATION

This application is a continuation of U.S. patent application Ser. No. 12/785,800, filed May 24, 2010, and which application claims priority from Japanese patent application JP 2009-131609 filed on May 29, 2009, the contents of which are hereby incorporated by reference into this application.

BACKGROUND OF THE INVENTION

1. Field of the Invention

The present invention relates to a gate signal line driving circuit and a display device using the gate signal line driving circuit, and more particularly to a technique which realizes the suppression of noises of a gate signal outputted from the gate signal line driving circuit.

2. Description of the Related Art

Conventionally, for example, with respect to a liquid crystal display device, there may be a case where a shift register built-in flat panel is adopted. Here, this method is a method in which a shift register circuit provided to a gate signal line driving circuit for scanning gate signal lines is formed on the same substrate as thin film transistors (hereinafter referred to as TFTs) which are arranged in pixel regions of a display panel. A shift register circuit of the related art is disclosed in JP 2007-95190 A and JP 2008-122939 A.

In each one of a plurality of basic circuits which are included in the shift register circuit provided to a gate signal line driving circuit, within one frame period, only during a gate scanning period in which a gate signal is outputted from the basic circuit to a gate signal line (hereinafter referred to as "signal HIGH period"), a HIGH voltage is outputted to the gate signal line as a gate signal $G_{out}$, and during a remaining period (hereinafter referred to as "signal LOW period"), a LOW voltage is outputted to the gate signal line as a gate signal $G_{out}$.

FIG. 10 is a schematic view simply showing the configuration of a basic circuit of a shift register circuit of a related art. The basic circuit of the shift register circuit includes a LOW voltage applying switching element SWA which outputs a LOW voltage to the gate signal line in response to the signal LOW period, and a HIGH voltage applying switching element SWG which outputs a HIGH voltage to the gate signal line in response to the signal HIGH period.

A LOW voltage line $V_{GL}$ is connected to an input terminal of the LOW voltage applying switching element SWA. To output the LOW voltage stably with respect to the gate signal $G_{out}$ of the basic circuit in response to the signal LOW period, the LOW voltage applying switching element SWA is turned on in response to the signal LOW period, so that a LOW voltage which is a voltage of the LOW voltage line $V_{GL}$ is outputted to the gate signal $G_{out}$. Further, the LOW voltage applying switching element SWA is turned off in response to the signal HIGH period. A voltage applied to a switch of the LOW voltage applying switching element SWA is set as a voltage of a node N2. During a period in which the LOW voltage applying switching element SWA is turned on, the node N2 assumes a HIGH voltage, and a HIGH voltage is applied to the switch of the LOW voltage applying switching element SWA. Further, during a period in which the LOW voltage applying switching element SWA is turned off, the node N2 assumes a LOW voltage, and a LOW voltage is applied to the switch of the LOW voltage applying switching element SWA.

A basic clock signal CLK is inputted to an input terminal of the HIGH voltage applying switching element SWG. To enable the outputting of the HIGH voltage during the signal HIGH period, with respect to the corresponding gate signal line, the HIGH voltage applying switching element SWG is turned on in response to the signal HIGH period, so that a voltage of the basic clock signal CLK is outputted to the gate signal $G_{out}$. Here, the basic clock signal CLK assumes a HIGH voltage during the signal HIGH period. Further, the HIGH voltage applying switching element SWG is turned off in response to the signal LOW period, so that the outputting of the basic clock signal CLK is interrupted or the basic clock signal CLK is not outputted. A voltage applied to a switch of the HIGH voltage applying switching element SWG is set as a voltage of a node N1. During a period in which the HIGH voltage applying switching element SWG is turned on, the node N1 assumes a HIGH voltage, and a HIGH voltage is applied to a switch of the HIGH voltage applying switching element SWG. Further, during a period in which the HIGH voltage applying switching element SWG is turned off, the node N1 assumes a LOW voltage, and a LOW voltage is applied to the switch of the HIGH voltage applying switching element SWG.

To the switch of the HIGH voltage applying switching element SWG, that is, to the node N1, a switching signal supply switching element SWB which supplies a LOW voltage in response to the signal LOW period is connected. The LOW voltage line $V_{GL}$ is connected to an input terminal of the switching signal supply switching element SWB. The switching signal supply switching element SWB is turned on in response to the signal LOW period so that the node N1 assumes a LOW voltage, and the LOW voltage is applied to a switch of the HIGH voltage applying switching element SWG. Further, the switching signal supply switching element SWB is turned off in response to the signal HIGH period. The switch of the switching signal supply switching element SWB is electrically connected to the switch of the LOW voltage applying switching element SWA, so that the voltages applied to the switches are equal to the voltage of the node N2. During a period in which the switching signal supply switching element SWB is turned on, as described above, the node N2 assumes a HIGH voltage, and the HIGH voltage is applied to the switch of the switching signal supply switching element SWB.

FIG. 11 is a circuit diagram of a basic circuit of a shift register circuit of a related art. As shown in FIG. 11, a transistor T6 provided to a LOW voltage applying switching circuit 211 corresponds to the LOW voltage applying switching element SWA. A node N2 is held at a HIGH voltage in response to a signal LOW period, and a LOW voltage of a LOW voltage line $V_{GL}$ is outputted from an output terminal OUT as a gate signal $G_n$.

Further, as shown in FIG. 11, a transistor T5 provided to a HIGH voltage applying switching circuit 212 corresponds to the HIGH voltage applying switching element SWG. A node N1 assumes a HIGH voltage in response to a signal HIGH period, and a voltage of a basic clock signal CLK1 inputted from an input terminal IN1 is outputted from the output terminal OUT as a gate signal $G_n$.

Further, as shown in FIG. 11, a transistor T2 provided to a node N1 LOW voltage supply circuit 213 corresponds to the switching signal supply switching element SWB. When a transistor T7 which constitutes the LOW voltage applying OFF control element provided to a node N2 LOW voltage supply circuit 214 is turned on, the voltage of the node N2 is changed to a LOW voltage. Further, along with a change of a voltage of the node N1 to a HIGH voltage in response to the signal HIGH period, a transistor T4 is turned on, so that a voltage of the node N2 is held at a LOW voltage.

That is, the node N1 is held at a LOW voltage and the node N2 is held at a HIGH voltage in response to the signal LOW period, and the node N1 is changed to a HIGH voltage and the node N2 is changed to a LOW voltage in response to the signal HIGH period.

SUMMARY OF THE INVENTION

A gate signal $G_n$ is outputted to a corresponding gate signal line. The gate signal line is arranged so as to extend through a plurality of corresponding pixel regions. In the respective pixel regions, corresponding data signal lines are arranged. A voltage of a data signal is applied to the data signal line such that the voltage is applied to pixel electrodes of the corresponding pixel regions.

Due to an inner capacitance of the transistor which constitutes a switching element arranged in each pixel region or the like, there may be a case where data signals applied to the respective data signal lines are applied to the gate signal lines as noises.

An input terminal IN3 is connected to a gate electrode of the transistor T7, and a gate signal $G_{n-1}$ of a preceding basic circuit is inputted to the input terminal IN3. Accordingly, when noises are applied to the gate signal $G_{n-1}$, there may be a case where the transistor T7 is partially turned on due to the noises. When the transistor T7 is partially turned on, due to a LOW voltage of the LOW voltage line $V_{GL}$ which is connected to an input terminal of the transistor T7, a voltage of the node N2 which should be held at a HIGH voltage in response to a signal OFF period is lowered. Then, the transistor T6 which holds the gate signal $G_n$ at a LOW voltage in response to a signal OFF period cannot maintain a state where the transistor T6 is sufficiently turned on due to the lowering of a voltage of the node N2.

If a state where the transistor T6 is sufficiently turned on cannot be held, for example, even when a noise signal is generated via the transistor T5 or from an external gate signal line, the noise signal is not sufficiently absorbed to the LOW voltage line $V_{GL}$ and hence, the noise signals cannot be suppressed.

That is, due to a noise signal contained in the gate signal $G_{n-1}$ of the preceding basic circuit, a noise signal is also applied to the gate signal $G_n$ of the basic circuit. Further, the noise signal is also applied to a gate signal $G_{n+1}$ in a succeeding basic circuit. Then, the noise signal is generated in a chain-like manner.

The invention has been made to overcome such drawbacks, and it is an object of the invention to provide a gate signal line driving circuit which can suppress noises in gate signals and a display device using the gate signal line driving circuit.

(1) According to one aspect of the invention, there is provided a gate signal line driving circuit which includes a plurality of basic circuits each of which outputs a gate signal having a HIGH voltage during a signal HIGH period and having a LOW voltage during a signal LOW period which is a period other than the signal HIGH period to a gate signal line, wherein the plurality of basic circuits includes a first basic circuit, and a second basic circuit which assumes a signal HIGH period before the signal HIGH period of the first basic circuit, the first basic circuit and the second basic circuit respectively include: a LOW voltage applying switching circuit which applies a LOW voltage to the gate signal line in response to the signal LOW period; a HIGH voltage applying switching element which applies a HIGH voltage to the gate signal line in response to the signal HIGH period; and a LOW voltage applying OFF control element which applies a LOW voltage to a switching input terminal of the LOW voltage applying switching circuit such that the LOW voltage applying switching circuit is turned off in response to the signal HIGH period, wherein the LOW voltage applying OFF control element of the first basic circuit is turned on in response to a signal applied to a switch of the HIGH voltage applying switching element of the second basic circuit.

(2) In the gate signal line driving circuit having the above-mentioned Item (1), in the first basic circuit, the HIGH voltage applying switching element may be turned on after the switch of the LOW voltage applying switching circuit is turned off in response to the signal HIGH period.

(3) In the gate signal line driving circuit having the above-mentioned Item (1) or (2), in the first basic circuit, the LOW voltage applying switching circuit may include a plurality of LOW voltage applying switching elements which are connected to the gate signal line parallel to each other, apply a LOW voltage to the gate signal lines in an ON state respectively, and the plurality of LOW voltage applying switching elements may be turned on and off respectively such that at least one of the LOW voltage applying switching elements is brought into an ON state in response to the signal LOW period, and at least one of the LOW voltage applying switching elements may be brought into an OFF state within at least a section of the signal LOW period.

(4) A display device may include the gate signal line driving circuit having any one of the Item (1) to (3).

DETAILED DESCRIPTION OF THE INVENTION

First Embodiment

Figure 1:
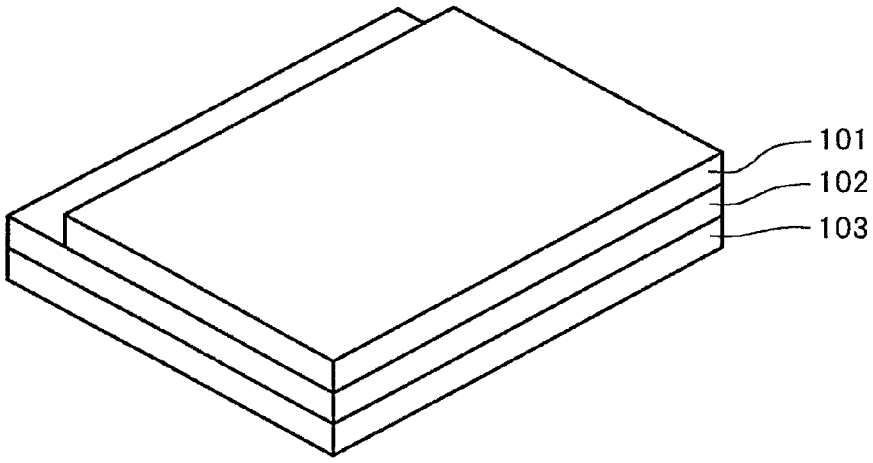
FIG. 1 is a perspective view showing the whole constitution of a liquid crystal display device according to an embodiment of the invention.

A display device according to a first embodiment of the invention is, for example, an IPS (In-Plane Switching) liquid crystal display device. As shown in FIG. 1 which is a perspective view showing the whole constitution of the liquid crystal display device, the liquid crystal display device is constituted of: a TFT substrate 102 on which gate signal lines 105, data signal lines 107, pixel electrodes 110, common electrodes 111, TFTs 109 and the like are arranged; a filter substrate 101 which faces the TFT substrate 102 in an opposed manner and mounts color filters thereon; a liquid crystal material which is sealed in a region sandwiched between both substrates; and a backlight 103 which is positioned such that the backlight 103 is brought into contact with a side opposite to a filter-substrate-101 side of the TFT substrate 102.

Figure 2:
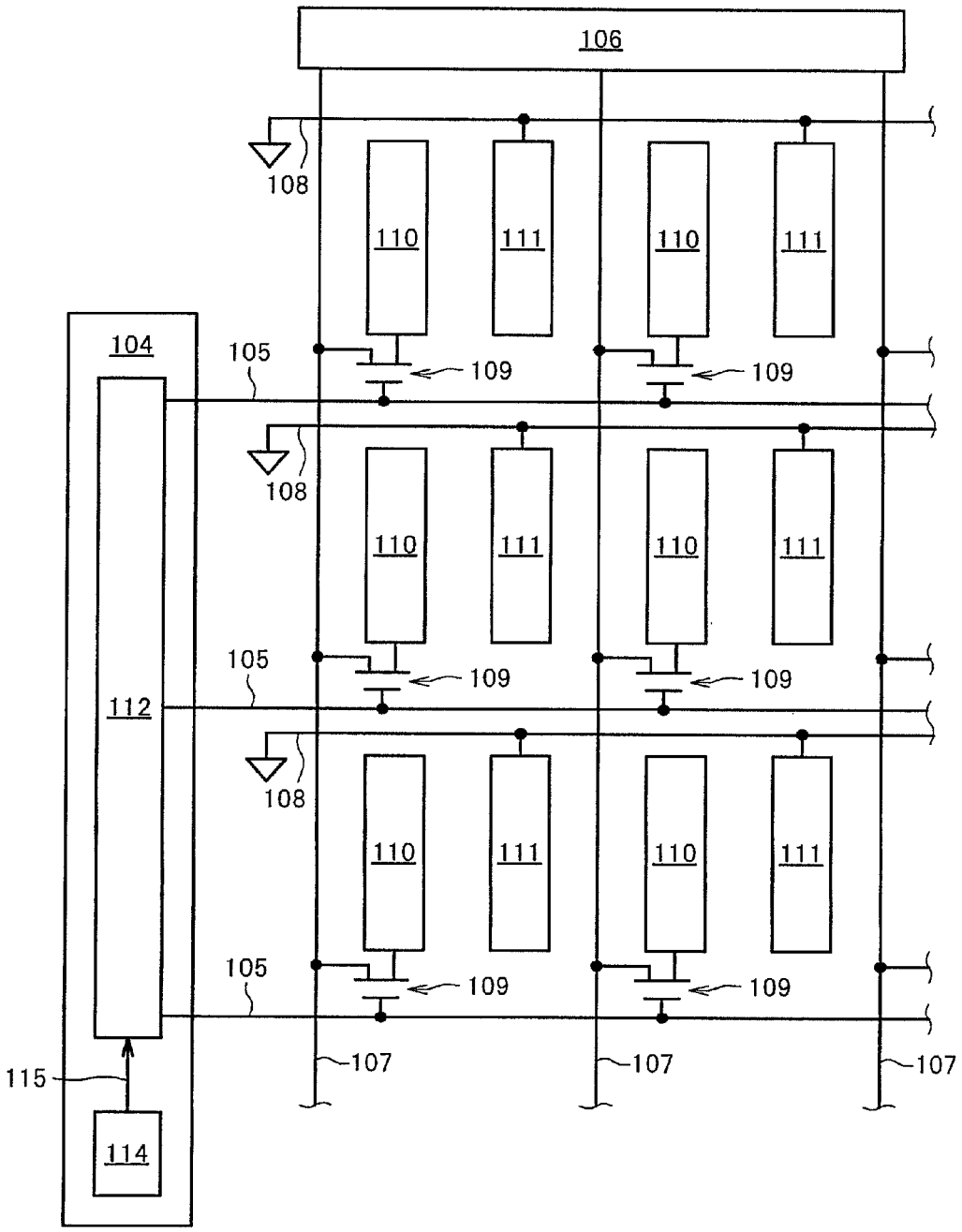
FIG. 2 is a conceptual view of an equivalent circuit of a TFT substrate provided to the liquid crystal display device according to the embodiment of the invention.

FIG. 2 is a conceptual view of an equivalent circuit of the TFT substrate 102. On the TFT substrate 102, a large number of gate signal lines 105 which are connected to a gate signal line driving circuit 104 are arranged parallel to each other at equal intervals and extend in the lateral direction in the drawing.

The gate signal line driving circuit 104 includes a shift register control circuit 114 and a shift register circuit 112. The shift register control circuit 114 outputs control signals 115 described later to the shift register circuit 112.

The shift register circuit 112 includes a plurality of basic circuits 113 which corresponds to the plurality of gate signal lines 105 respectively. For example, when there are 800 pieces of gate signal lines 105, the shift register circuit 112 includes the corresponding number of basic circuits 113, that is, 800 pieces of basic circuits 113. In response to control signals 115 inputted from the shift register control circuit 114, each basic circuit 113 outputs a gate signal to the corresponding gate signal line 105, wherein within one frame period, the gate signal assumes a HIGH voltage in a corresponding gate scanning period (signal HIGH period) and assumes a LOW voltage in another period (signal LOW period).

Further, a large number of data signal lines 107 which are connected to a data driving circuit 106 are arranged parallel to each other at equal intervals and extend in the longitudinal direction in the drawing. Pixel regions which are arranged in a matrix array are each defined by the gate signal line 105 and the data signal line 107. Further, common signal lines 108 extend parallel to the respective gate signal lines 105 in the lateral direction in the drawing.

At a corner in each of the pixel regions which are defined by the gate signal lines 105 and the data signal lines 107, the TFT 109 is formed. The TFT 109 is connected to the data signal line 107 and the pixel electrode 110. Further, a gate electrode of the TFT 109 is connected to the gate signal line 105. In each pixel region, a common electrode 111 is formed such that the common electrode 111 faces the pixel electrode 110 in an opposed manner.

In the above-mentioned circuit configuration, a reference voltage is applied to the common electrodes 111 of the respective pixel circuits via the common signal line 108. Further, by selectively applying a gate voltage to the gate electrode of the TFT 109 via the gate signal line 105, an electric current which flows in the TFT 109 can be controlled. A voltage of a data signal which is supplied to the data signal line 107 is applied to the pixel electrode 110 via the TFT 109 in which the gate voltage is applied to the gate electrode thereof. Accordingly, a potential difference is generated between the pixel electrode 110 and the common electrode 111, so that the alignment of liquid crystal molecules and the like are controlled whereby the degree of blocking of light from the backlight 103 is controlled thus enabling the display of an image.

In FIG. 2, for the sake of brevity, only the left side shift register circuit 112 is shown. However, in an actual operation, a basic circuit 113 of the shift register circuit 112 is arranged on both left and right sides of the display region. Assuming that there exist 800 pieces of gate signal lines 105, for example, the plurality of basic circuits 113 which are arranged on both sides of the display region supply gate signals to these signal lines respectively in such a manner that the basic circuits 113 arranged on a right side supply gate signals to the odd-numbered signal lines, and the basic circuits 113 arranged on a left side supply gate signals to the even-numbered signal lines, for example.

Figure 3:
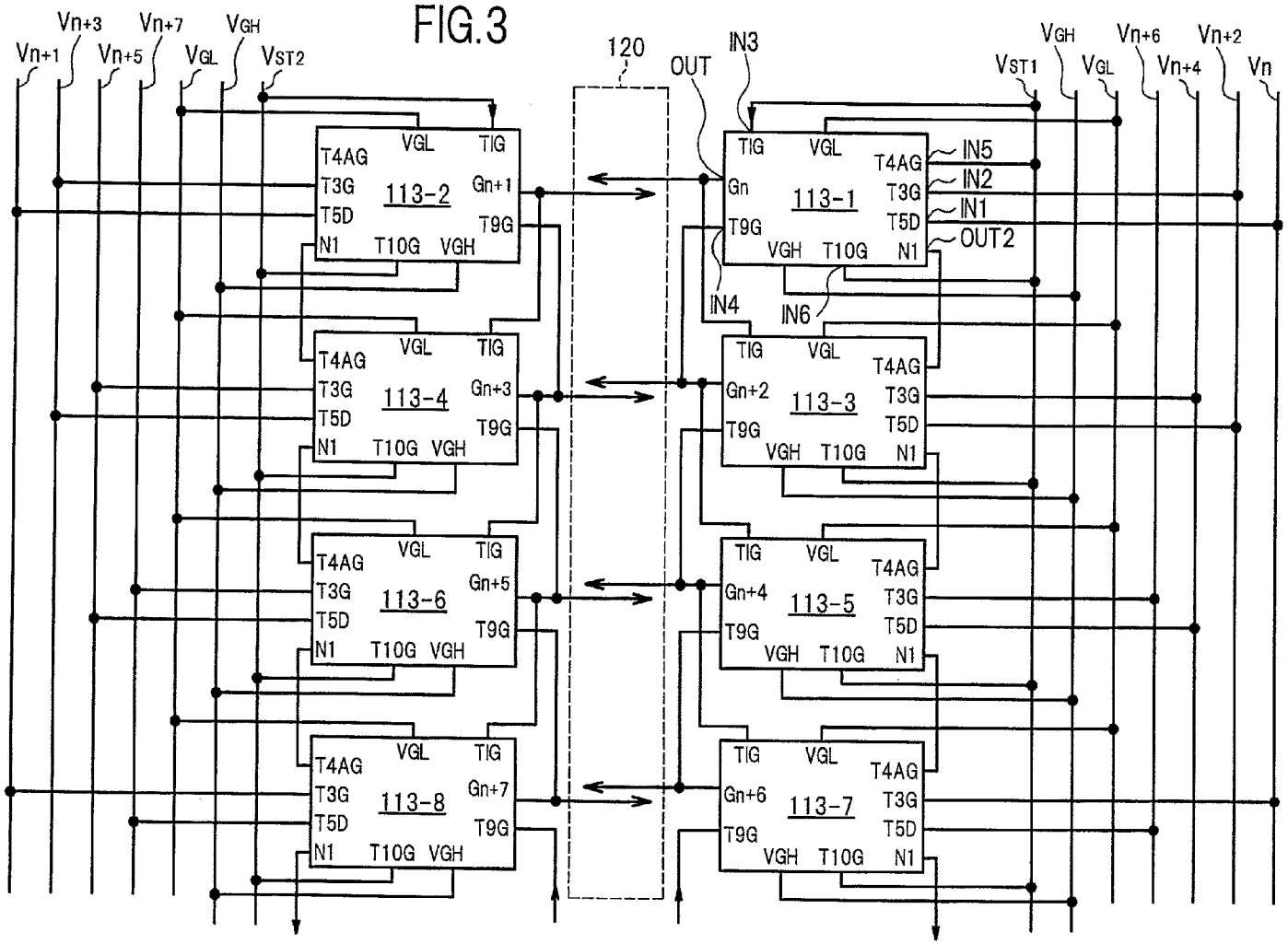
FIG. 3 is a block diagram of a shift register circuit according to the embodiment of the invention.

FIG. 3 is a block diagram of the shift register circuit 112. Out of the basic circuits 113 which are arranged on both sides, the odd-numbered basic circuits 113 are arranged on a right side in FIG. 3, and the even-numbered basic circuits 113 are arranged on a left side in FIG. 3. The respective basic circuits 113 output gate signals $G_n$ to the display region 120 positioned at the center in FIG. 3. In FIG. 3, the n-th basic circuit is indicated as the basic circuit 113-*n*.

Control signals 115 which the shift register control circuit 114 outputs to the shift register circuit 112 are inputted to the odd-numbered basic circuits 113 positioned on a right side in FIG. 3 and to the even-numbered basic circuits 113 positioned on a left side in FIG. 3. To the odd-numbered basic circuits 113, four basic clock signals $V_n$, $V_{n+2}$, $V_{n+4}$, $V_{n+6}$ which differ from each other in phase, a HIGH voltage $V_{GH}$, a LOW voltage $V_{GL}$, an auxiliary signal $V_{ST1}$ and the like are inputted. In the same manner as described above, to the even-numbered basic circuits 113, four basic clock signals $V_{n+1}$, $V_{n+3}$, $V_{n+5}$, $V_{n+7}$ which differ from each other in phase, a HIGH voltage $V_{GH}$, a LOW voltage $V_{GL}$, an auxiliary signal $V_{ST2}$ and the like are inputted.

Each basic circuit 113 shown in FIG. 3 includes, as can be understood from the basic circuit 113-1 in the drawing, six input terminals IN1, IN2, IN3, IN4, IN5 and IN6 and two output terminals OUT, OUT2. Further, a HIGH voltage line $V_{GH}$ and a LOW voltage line $V_{GL}$ are connected to each basic circuit 113.

The input terminals IN1, IN2 of the n-th basic circuit 113-*n* are explained hereinafter. In the n-th basic circuit 113-*n*, basic clock signals $V_n$, $V_{n+2}$ are inputted to the input terminals IN1, IN2 respectively. Here, 2 basic clock signals are connected to each basic circuit and hence, even when a value of "n" is changed, the basic clock signals may be set to satisfy the phase relationship of $V_{n+8}=V_n=V_{n-8}$ or the like.

A gate signal which is outputted from the output terminal OUT of the n-th basic circuit 113-*n* is defined as "$G_n$". To the input terminal IN3 of the n-th basic circuit 113-*n*, a gate signal $G_{n-2}$ from the (n−2)th basic circuit 113-(*n*−2) is inputted. In the same manner, to the input terminal IN4, a gate signal $G_{n+2}$ from (n+2)th basic circuit 113-(*n*+2) is inputted. Here, there are no gate signals corresponding to the input terminals IN3 of the first basic circuit 113-1 and the second basic circuit 113-2 and hence, auxiliary signals $V_{ST1}$, $V_{ST2}$ are inputted to the input terminals IN3 respectively. In the same manner, a gate signal $G_{801}$ of an 801st dummy circuit is inputted to the input terminal IN4 of a 799th basic circuit 113-799, and a gate signal $G_{802}$ of an 802nd dummy circuit is inputted to the input terminal IN4 of an 800th basic circuit 113-800. The auxiliary signals $V_{ST1}$, $V_{ST2}$ are inputted to the input terminal IN4 of the 801st dummy and the input terminal IN4 of the 802nd dummy circuit respectively.

Further, an output signal from the output terminal OUT2 of the (n−2)th basic circuit 113-(*n*−2) is inputted to the input terminal IN5 of the n-th basic circuit 113-*n*, and a voltage of the node N1 of an n-th basic circuit 113-*n* is outputted to the output terminal OUT2 of the n-th basic circuit 113-*n*. Here, there is no voltage of the node N1 corresponding to the input terminals IN5 of the first basic circuit 113-1 and the second basic circuit 113-2 and hence, the auxiliary signals $V_{ST1}$, $V_{ST2}$ are inputted to the input terminals IN5 respectively. Further, to the input terminal IN6 of the n-th basic circuit 113-*n*, the auxiliary signal $V_{ST1}$ is inputted when "n" is an odd number, and the auxiliary signal $V_{ST2}$ is inputted when "n" is an even number.

Figure 4:
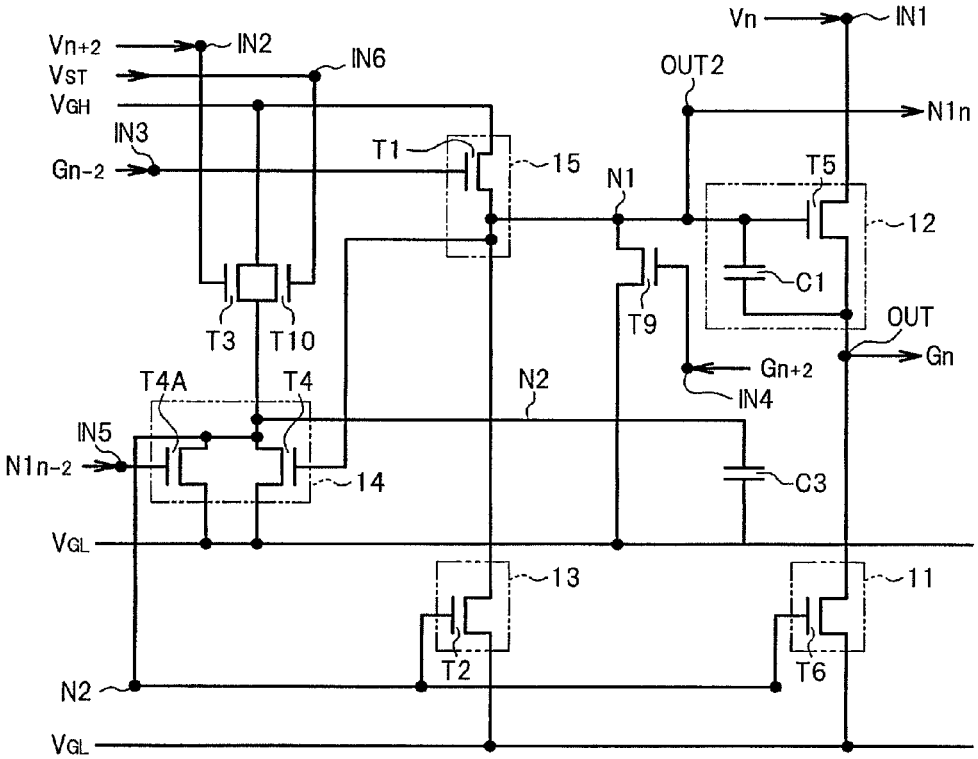
FIG. 4 is a circuit diagram of an n-th basic circuit according to a first embodiment of the invention.

FIG. 4 is a circuit diagram showing the n-th basic circuit 113-*n* of the shift register circuit 112. The auxiliary signal $V_{ST}$ which is inputted to the input terminal IN6 becomes the auxiliary signal $V_{ST1}$ when "n" is an odd number and becomes the auxiliary signal $V_{ST2}$ when "n" is an even number.

A point which mainly makes the shift register circuit of this embodiment different from the basic circuit of the shift register circuit according to the related art shown in FIG. 11 lies in the following constitution. In the shift register circuit according to the related art, in response to the signal HIGH period, the transistor T7 provided to the node N2 LOW voltage supply circuit 214 is turned on by the gate signal $G_{n-1}$ of the preceding basic circuit and hence, the node N2 is changed from a HIGH voltage to a LOW voltage. To the contrary, in the shift register circuit of this embodiment, in response to a signal HIGH period, a transistor T4A which constitutes a LOW voltage applying OFF control element provided to a node N2 LOW voltage supply circuit 14 is turned on by a voltage of the node N1 of the (n−2)th basic circuit and hence, the node N2 is changed from a HIGH voltage to a LOW voltage.

Here, assuming an n-th basic circuit 113-*n* as a first basic circuit, an (n−2)th basic circuit 113-(*n*−2) becomes a second basic circuit, and the transistor T4A of an n-th basic circuit 113-*n* is turned on by a voltage of the node N1 of the (n−2)th basic circuit 113-(*n*−2).

Figure 5:
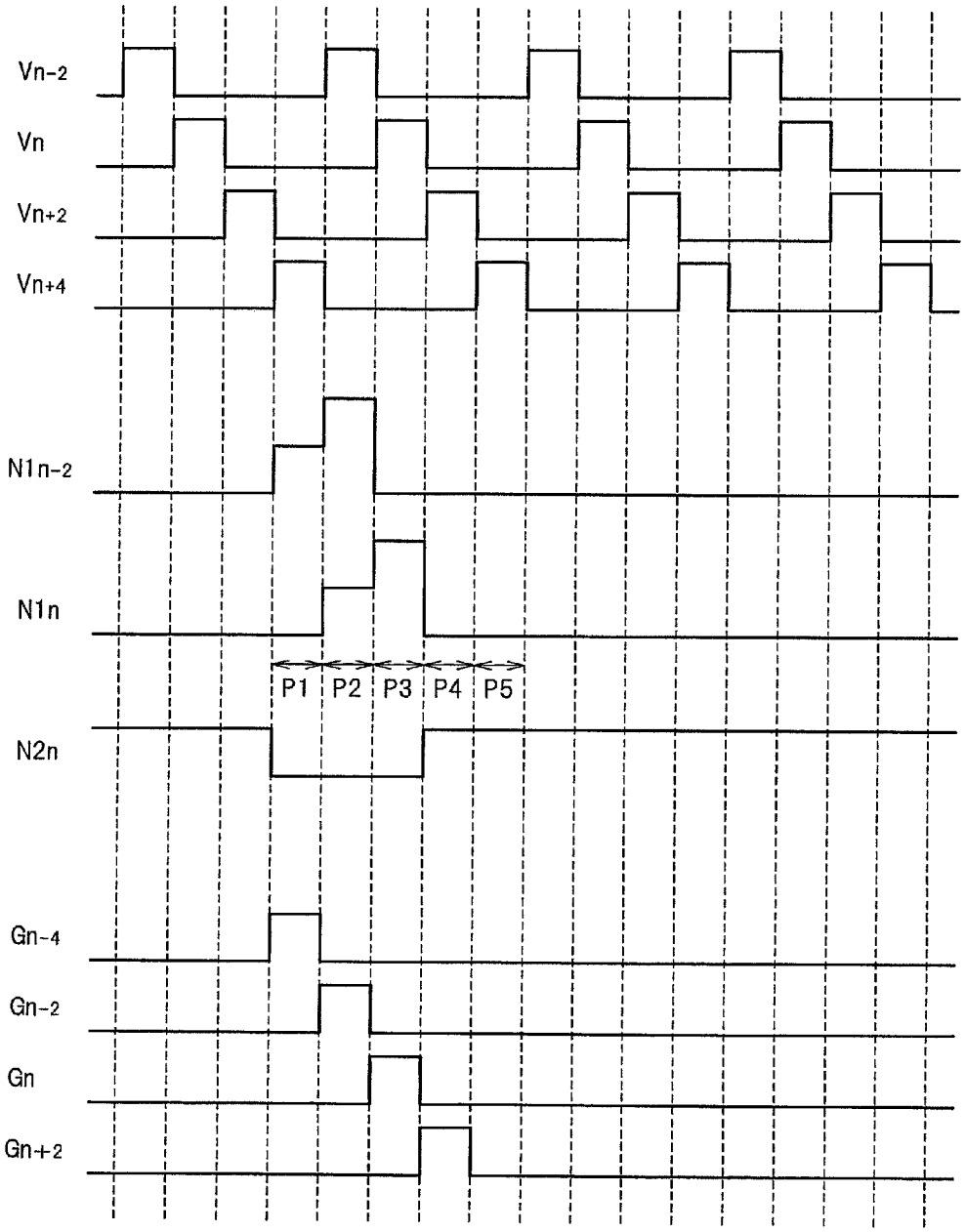
FIG. 5 is a timing chart showing a change in voltages with time of an input signal, a node and a gate signal according to an n-th basic circuit according to the first embodiment of the invention.

FIG. 5 shows a change with time in voltages of the nodes N1, N2 of the n-th basic circuit 113-*n* together with the basic clock signals which are input signals, a voltage of the node N1 of the preceding circuit, and gate signals of the neighboring basic circuits. Hereinafter, the manner of operation of the basic circuit 113 is explained along with a change of respective signals with time shown in FIG. 5.

As shown in FIG. 4, the input terminal IN5 is connected to a gate electrode of the transistor T4A, so that a voltage $N1_{n-2}$ of the node N1 which an output terminal OUT2 of the (n−2)th basic circuit 113-(*n*−2) outputs is inputted to the input terminal IN5. A voltage $N1_{n-2}$ of the node N1 of the (n−2)th basic circuit 113-(*n*−2) assumes a HIGH voltage within a period P1 shown in FIG. 5, so that the transistor T4A is turned on within the period P1.

The LOW voltage line $V_{GL}$ is connected to an input terminal of the transistor T4A. Accordingly, when the transistor T4A is turned on, a LOW voltage of the LOW voltage line $V_{GL}$ is applied to the node N2.

As shown in FIG. 4, the input terminal IN3 is connected to a gate electrode of a transistor T1 provided to a node N1 HIGH voltage supply circuit 15, and the gate signal $G_{n-2}$ of the (n−2)th basic circuit 113-(*n*−2) is inputted to the input terminal IN3. The gate signal $G_{n-2}$ of the (n−2)th basic circuit 113-(*n*−2) assumes a HIGH voltage within a period P2 shown in FIG. 5, so that the transistor T1 is turned on within the period P2.

The HIGH voltage line $V_{GH}$ is connected to an input terminal of the transistor T1. Accordingly, when the transistor T1 is turned on, a HIGH voltage of the HIGH voltage line $V_{GH}$ is applied to the node N1. Further, the input terminal and the gate terminal of the transistor T1 may be connected to each other to form a diode connection.

Here, within the period P2, as shown in FIG. 5, a voltage $N1_{n-2}$ of the node N1 of an (n−2)th basic circuit 113-(*n*−2) is held at a HIGH voltage, so that the transistor T4A is held in an ON state. Further, the node N1 is connected to a gate electrode of a transistor T4 provided to the node N2 LOW voltage supply circuit 14, so that the node N1 assumes a HIGH voltage within the period P2 whereby the transistor T4 is also turned on. The LOW voltage line $V_{GL}$ is connected to an input terminal of the transistor T4. Accordingly, within the period P2, the transistors T4, T4A are both turned on, so that a LOW voltage of the LOW voltage line $V_{GL}$ is applied to the node N2.

The input terminal IN1 is connected to an input terminal of a transistor T5 which corresponds to the HIGH voltage applying switching element SWG provided to a HIGH voltage applying switching circuit 12, so that the basic clock signal $V_n$ is inputted to the input terminal IN1. A gate terminal of the transistor T5 is connected the node N1. Within a period P3, the node N1 is held at a HIGH voltage, so that the transistor T5 is held in an ON state. Within the period P3, the basic clock signal $V_n$ assumes a HIGH voltage and hence, the gate signal $G_n$ which becomes a HIGH voltage is outputted from the output terminal OUT within the period P3 which is a signal HIGH period.

Here, in an actual operation, because of setting of a threshold voltage $V_{th}$ in the transistor T1, within the period P2, the node N1 assumes a voltage which is obtained by subtracting the threshold voltage $V_{th}$ of the transistor T1 from a HIGH voltage of the HIGH voltage line $V_{GH}$. With such a voltage, there exists a possibility that the transistor T5 cannot be sufficiently turned on within the period P3 which is the signal HIGH period. To cope with such a possibility, a boosting capacitance C1 is connected parallel to the transistor T5 in the HIGH voltage applying switching circuit 12. Accordingly, within the period P3, although the gate signal $G_{n-2}$ is changed to a LOW voltage to turn off the transistor T1, the node N1 is held at a HIGH voltage, so that the transistor T5 is turned on and is held in an ON state. Within the period P3, a HIGH voltage of the basic clock signal $V_n$ which is inputted to the input terminal IN1 is applied to the output terminal OUT, and the node N1 is boosted to a higher voltage due to a capacitive coupling of the boosting capacitance C1. This voltage is referred to as a bootstrap voltage.

Here, within the period P3, as shown in FIG. 5, a voltage $N1_{n-2}$ of the node N1 of the (n−2)th basic circuit 113-(*n*−2) assumes a LOW voltage, so that the transistor T4A is turned off. However, a voltage of the node N1 of the n-th basic circuit 113-*n* is boosted to a high voltage due to the bootstrap voltage, so that the transistor T4 which is provided to the node N2 LOW voltage supply circuit 14 is held in an ON state whereby the node N2 is held at a LOW voltage even after the transistor T4A is turned off.

As shown in FIG. 4, the LOW voltage line $V_{GL}$ is connected to an input terminal of a transistor T9, and the input terminal IN4 is connected to a gate electrode of the transistor T9. The gate signal $G_{n+2}$ from the (n+2)th basic circuit 113-(*n*+2) is inputted to the input terminal IN4.

As shown in FIG. 5, the gate signal $G_{n+2}$ assumes a HIGH voltage within the period P4, so that, within the period P4, the transistor T9 is turned on and a LOW voltage of the LOW voltage line $V_{GL}$ is applied to the node N1. Accordingly, the transistor T5 is turned off. Further, the transistor T4 is also turned off simultaneously.

As shown in FIG. 4, between the LOW voltage line $V_{GL}$ and the HIGH voltage line $V_{GH}$, a holding capacitance C3 and a transistor T3 are connected in series. An output terminal of the transistor T3 and a positive pole of the holding capacitance C3 are connected to the node N2. Further, the LOW voltage line $V_{GL}$ is connected to a negative pole of the holding capacitance C3, and the HIGH voltage line $V_{GH}$ is connected to the input terminal of the transistor T3. The input terminal IN2 is connected to a gate electrode of the transistor T3, so that the basic clock signal $V_{n+2}$ is inputted to the input terminal IN2.

Since the basic clock signal $V_{n+2}$ assumes a HIGH voltage within the period P4, the transistor T3 is turned on within the period P4, so that a voltage of the node N2 is changed to a HIGH voltage. Simultaneously, the holding capacitance C3 is charged with a HIGH voltage.

Then, even after the basic clock signal $V_{n+2}$ assumes a LOW voltage within the period P5 to turn off the transistor T3, a voltage of the node N2 is held at a HIGH voltage due to the holding capacitance C3. Further, the basic clock signal $V_{n+2}$ periodically assumes a HIGH voltage so as to periodically keep charging the holding capacitance C3 and hence, a voltage of the node N2 is stably held at a HIGH voltage.

Figure 11:
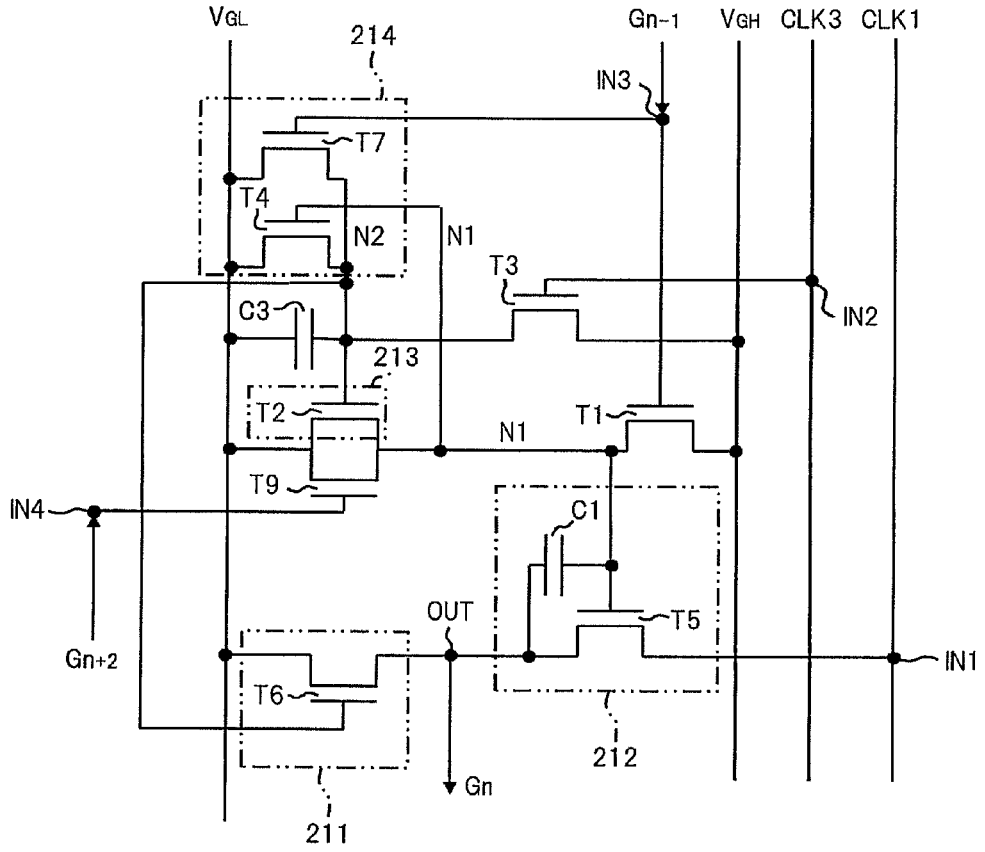
FIG. 11 is a circuit diagram showing one example of the basic circuit of the shift register circuit according to the related art.

Further, differently from the basic circuit of the related art shown in FIG. 11, the n-th basic circuit 113-*n* shown in FIG. 4 is provided with a transistor T10 in parallel to the transistor T3. The input terminal IN6 is connected to a gate electrode of the transistor T10, and the above-mentioned auxiliary signal $V_{ST}$ is inputted to the input terminal IN6. In addition to the periodical charging of the holding capacitance C3 due to the periodical turning-on of the transistor T3, the transistor T10 is turned on every time the auxiliary signal $V_{ST}$ assumes a HIGH voltage. Also with such an operation, the holding capacitance C3 is charged.

Here, as described above, the auxiliary signal $V_{ST}$ indicates the auxiliary signal $V_{ST1}$ when "n" is an odd number, and indicates the auxiliary signal $V_{ST2}$ when "n" is an even number. Accordingly, the n-th basic circuit 113-*n* where "n" is an odd number has the holding capacitances C3 simultaneously charged through the transistors T10 at timing when the auxiliary signal $V_{ST1}$ assumes a HIGH voltage. The n-th basic circuit 113-*n* where "n" is an even number has the holding capacitance C3 simultaneously charged through the transistors T10 at timing when the auxiliary signal $V_{ST2}$ assumes a HIGH voltage respectively. By setting the auxiliary signal $V_{ST}$ to a HIGH voltage in a blanking period which is a time other than a period in which data is written in the display region or the like within one frame, it is possible to more stably hold the node N2 at a HIGH voltage in response to a signal OFF period.

A node N1 LOW voltage supply circuit 13 is provided with a transistor T2 which corresponds to the switching signal supply switching element SWB, and a LOW voltage applying switching circuit 11 is provided with a transistor T6 which corresponds to the LOW voltage applying switching element SWA. A node N2 is connected to gate electrodes of the transistors T2, T6, and a LOW voltage line $V_{GL}$ is connected to input terminals of the transistors T2, T6. In response to a signal OFF period, the node N2 is held at a HIGH voltage, so that the transistor T2 is turned on. When the transistor T2 is held in an ON state, a LOW voltage of the LOW voltage line $V_{GL}$ is applied to the node N1. That is, the node N1 is held at a LOW voltage in response to the signal OFF period.

In the same manner, in response to a signal OFF period, the transistor T6 is turned on, so that the gate signal $G_n$ which becomes a LOW voltage of the LOW voltage line $V_{GL}$ is outputted from the output terminal OUT.

As described above, in response to a signal HIGH period, the node N1 assumes a HIGH voltage within the periods P2 and P3, so that the transistor T5 which constitutes a HIGH voltage applying switching element is turned on. Within these periods, a voltage of the basic clock signal $V_n$ is outputted from the output terminal OUT as a gate signal $G_n$. Particularly, within the period P3, the basic clock signal $V_n$ assumes a HIGH voltage and hence, the gate signal $G_n$ also assumes a HIGH voltage within the period P3. Further, in response to a signal HIGH period, within the periods P1, P2 and P3, the node N2 assumes a LOW voltage, so that the transistor T6 which constitutes a LOW voltage applying switching element and the transistor T2 which constitutes a switching signal supply switching element are turned off.

Further, in response to a signal LOW period, during 1 frame period, within periods other than the periods P1, P2, P3, the node N2 is held at a HIGH voltage, so that the transistor T2 is turned on whereby the node N1 is held at a LOW voltage. Simultaneously, the transistor T6 is turned on, so that a LOW voltage of the LOW voltage line $V_{GL}$ is outputted as a gate signal $G_n$ from the output terminal OUT. Then, within most of 1 frame period, a HIGH voltage is applied to the gate electrode of the transistor T6 and the gate electrode of the transistor T2. Here, although the transistor T2 is turned off within the period P1, the node N1 is held at a LOW voltage.

In this manner, the node N2 of the n-th basic circuit 113-*n* is changed from a HIGH voltage to a LOW voltage in response to a signal HIGH period not based on a so-called external signal which is directly connected to a region outside the shift register circuit 112 such as a display region, like the gate signal $G_{n-2}$ of the (n−2)th basic circuit 113-(*n*−2), but based on a voltage $N1_{n-2}$ of the node N1 of the (n−2)th basic circuit 113-(*n*−2).

A voltage $N1_{n-2}$ of the node N1 is outputted from the output terminal OUT2 of the (n−2)th basic circuit 113-(*n*−2) and is inputted to the input terminal IN5 of the n-th basic circuit 113-*n*. However, the voltage $N1_{n-2}$ is not outputted to the outside of the shift register circuit 112, so that the node N1 is not directly connected to a region outside the shift register circuit 112. That is, the voltage $N1_{n-2}$ is a so-called internal signal of the shift register circuit 112.

As has been explained heretofore, the node N2 of the n-th basic circuit 113-*n* is changed from a HIGH voltage to a LOW voltage in response to a signal HIGH period not based on the external signal to which a noise signal is applied from the outside such as a gate signal but based on an internal signal of the shift register circuit 112 which is not directly connected to a region outside the shift register circuit 112 such as a voltage of the node N1. Accordingly, it is possible to prevent the node N2 from being influenced by the noise signal generated outside the shift register circuit 112. As a result, it is possible to suppress the noises of the gate signal which the gate signal line driving circuit 104 provided with the shift register circuit 112 outputs. Further, display quality of a display device using such a gate signal line driving circuit 104 can be enhanced.

Further, in response to a signal HIGH period, a voltage of the node N1 and a voltage of the node N2 are changed from a LOW voltage to a HIGH voltage and from a HIGH voltage to a LOW voltage respectively based on different signals. By selectively using such signals as in the case of this embodiment, for example, it is possible to make timing at which such a voltage change occurs different between the node N1 and the node N2.

In this embodiment, the node N2 is changed from a HIGH voltage to a LOW voltage at a point of time when the period P1 starts. The node N2 assumes a LOW voltage within the period P1, and the transistor T2 which holds the node N1 at a LOW voltage is turned off. Thereafter, the node N1 is changed from a LOW voltage to a HIGH voltage at a point of time when the period P2 starts.

Here, when the voltage change occurs at the same timing between the node N1 and the node N2 as in the case of the basic circuit of the related art shown in FIG. 11, for example, timing at which the transistor T1 is turned on and timing at which the transistor T2 is turned off are equal. In an actual operation, due to respective threshold voltages which these transistors have, it takes a certain time until the transistor T1 is sufficiently turned on or the transistor T2 is sufficiently turned off. That is, the transistor T1 is partially turned on before the transistor T2 is sufficiently turned off and hence, there may be a possibility that the node N1 is made partially conductive with both the HIGH voltage line $V_{GH}$ and the LOW voltage line $V_{GL}$ and hence, the voltage change of the node N1 from a LOW voltage to a HIGH voltage takes more time.

To the contrary, in the n-th basic circuit 113-*n* according to this embodiment, the transistor T1 is turned on after the transistor T2 is sufficiently turned off, so that a voltage of the node N1 can be stably changed from a LOW voltage to a HIGH voltage within a short period.

Further, as described above, a voltage of the node N2 is changed from a HIGH voltage to a LOW voltage before timing when a voltage of the node N1 is changed from a LOW voltage to a HIGH voltage and hence, the transistor T1 does not require high driving ability. Accordingly, a distance between the electrodes of the transistor T1 can be further increased thus enhancing a yield rate of products. Further, a width of the electrode of the transistor T1 can be further shortened and hence, A thinner bezel can be realized in the display panel thus increasing an added value of a flat panel. Here, in this embodiment, although the explanation has been made with respect to the basic clock signals having four phases, the invention of this embodiment is also applicable to a case where the basic clock signals have five or more phases.

Second Embodiment

A display device according to a second embodiment of the invention basically has the same constitution as the display device according to the above-mentioned first embodiment. A point which mainly makes the display device of this embodiment different from the display device according to the first embodiment lies in the configuration of the basic circuit 113 of the shift register circuit 112.

Figure 6:
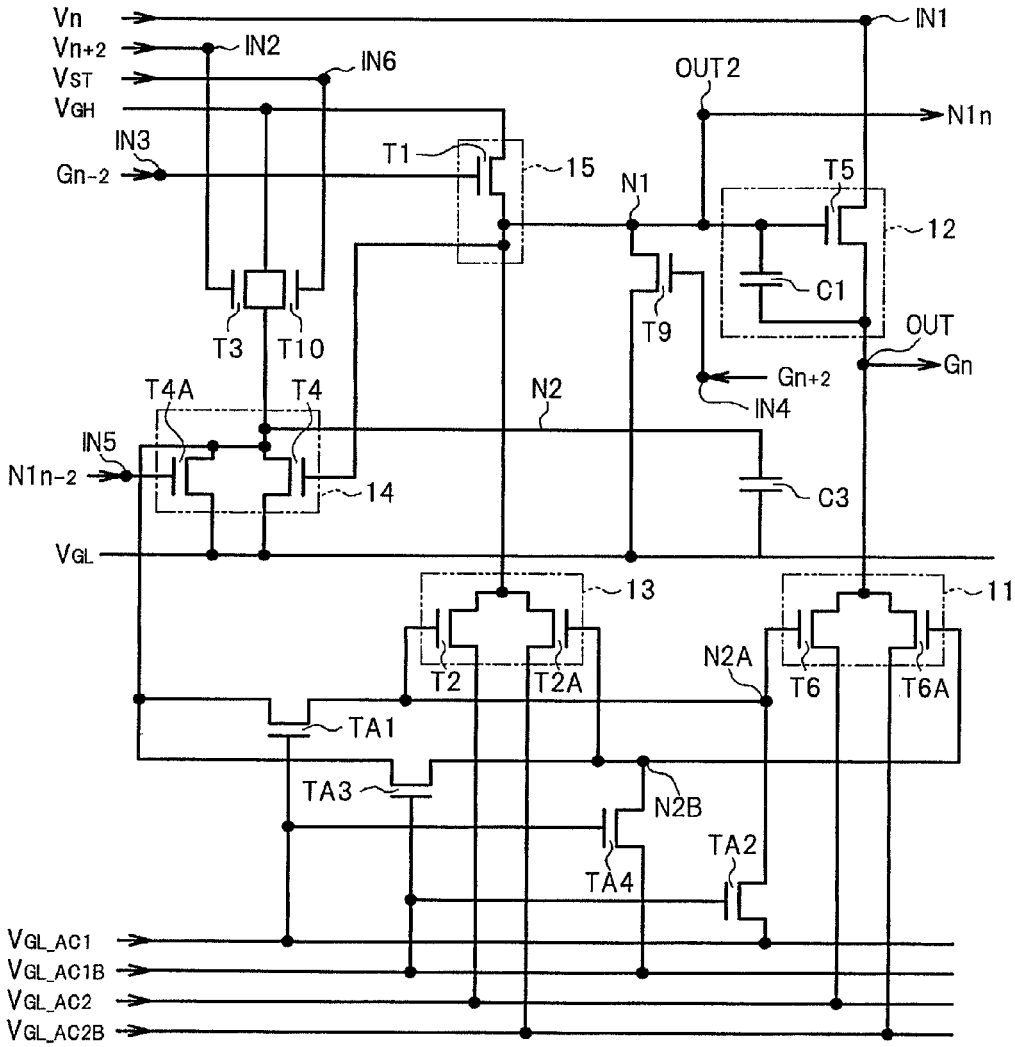
FIG. 6 is a circuit diagram of an n-th basic circuit according to a second embodiment of the invention.

FIG. 6 is a circuit diagram of an n-th basic circuit 113-*n* provided to the display device according to the second embodiment of the invention. A point which mainly makes the n-th basic circuit 113-*n* of this embodiment different from the n-th basic circuit 113-*n* according to the first embodiment shown in FIG. 4 lies in the following configuration. In the basic circuit 113 according to the first embodiment, the LOW voltage applying switching circuit 11 is provided with one transistor T6 which corresponds to the LOW voltage applying switching element SWA, while in the basic circuit 113 according to this embodiment, a LOW voltage applying switching circuit 11 is provided with two transistors T6, T6A which are connected parallel to each other. In the same manner, in the basic circuit 113 according to the first embodiment, the node N1 LOW voltage supply circuit 13 is provided with one transistor T2 which corresponds to the switching signal supply switching element SWB, while in the basic circuit 113 according to this embodiment, the node N1 LOW voltage supply circuit 13 is provided with two transistors T2, T2A which are connected parallel to each other.

Further, two pairs of AC voltage lines are further connected to the n-th basic circuit 113-*n* shown in FIG. 6. The node N2 is connected to one pair of AC voltage lines $V_{GL_AC1}$, $V_{GL_AC1B}$ via transistors TA1, TA2, TA3 and TA4 which constitute control switching elements. Further, input terminals of the transistor T2, T2A are connected to the other pair of AC voltage lines $V_{GL_AC2}$, $V_{GL_AC2B}$ respectively, and both output terminals of the transistors T2, T2A are connected to the node N1. In the same manner, input terminals of the transistors T6, T6A are connected to the pair of AC voltage lines $V_{GL_AC2}$, $V_{GL_AC2B}$ respectively, and both output terminals of the transistors T6, T6A are connected to an output terminal OUT.

Gate electrodes of the transistors TA1, TA3 are connected to the pair of AC voltage lines $V_{GL_AC1}$, $V_{GL_AC1B}$ respectively. The node N2 is connected with nodes N2A, N2B respectively via the transistors TA1, TA3 which constitute control switching elements.

In the same manner, gate electrodes of the transistors TA4, TA2 are also connected to the pair of AC voltage lines $V_{GL_AC1}$, $V_{GL_AC1B}$ respectively. The AC voltage line $V_{GL_AC1}$ and the node N2A are connected with each other via the transistor TA2, and the AC voltage line $V_{GL_AC1B}$ and the node N2B are connected with each other via the transistor TA4.

The nodes N2A, N2B are connected to gate electrodes of the transistors T2, T2A respectively, and in the same manner the nodes N2A, N2B are connected to gate electrodes of the transistors T6, T6A respectively.

Figure 7A:
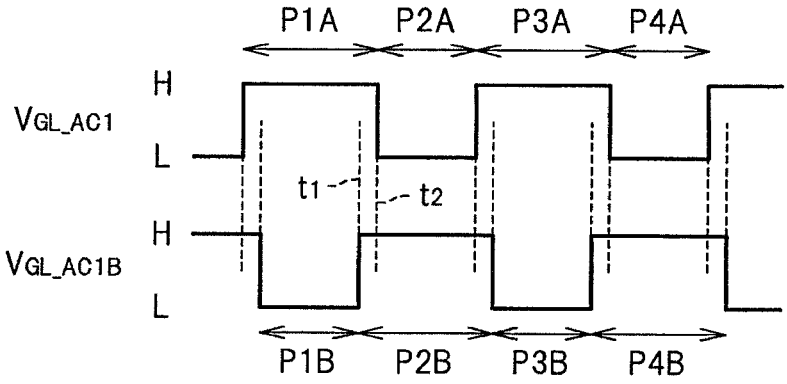
FIG. 7A and FIG. 7B are timing charts showing a change in voltages with time of AC voltage lines according to the second embodiment of the invention.
Figure 7B:
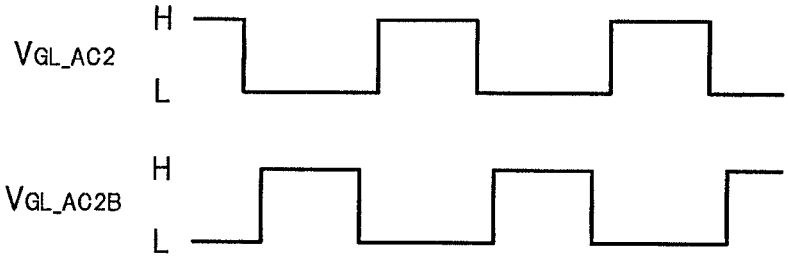

FIG. 7A and FIG. 7B are timing charts showing a change in voltages with time of two pairs of AC voltage lines, respectively. In these drawings, time is taken on an axis of abscissas, and HIGH voltages (H) and LOW voltages (L) of two pairs of AC voltage lines are taken on an axis of ordinates. As shown in FIG. 7A and FIG. 7B, voltages of two pairs of AC voltage lines are periodically changed such that the voltages alternately assume a HIGH voltage and a LOW voltage.

As shown in FIG. 7A, respective periods relating to the AC voltage line $V_{GL_AC1}$ are defined as P1A, P2A, P3A, . . . , respective periods relating to the AC voltage line $V_{GL_AC1B}$ are defined as P1B, P2B, P3B, . . . , and respective points of time shown in the drawing are defined as $t_1$, $t_2$. As shown in FIG. 7A, with respect to each of the pair of AC voltage lines $V_{GL_AC1}$, $V_{GL_AC1B}$, a period during which the voltage line assumes a HIGH voltage is set longer than a period during which the voltage line assumes a LOW voltage. For example, with respect to the AC voltage line $V_{GL_AC1}$, the periods P1A, P3A, . . . which are in a HIGH voltage state are set longer than the periods P2A, P4A, . . .

which are in a LOW voltage state. Further, as shown in FIG. 7B, the pair of AC voltage lines $V_{GL_AC2}$, $V_{GL_AC2B}$ has phases opposite to phases of the pair of AC voltage lines $V_{GL_AC1}$, $V_{GL_AC1B}$ respectively.

Accordingly, for example, the AC voltage line $V_{GL_AC1B}$ which assumes a LOW voltage within the period P1B is changed to a HIGH voltage at a point of time $t_1$. Thereafter, the AC voltage line $V_{GL_AC1}$ which assumes a HIGH voltage within the period P1A is changed to a LOW voltage at a point of time $t_2$. That is, with respect to the pair of AC voltage lines $V_{GL_AC1}$, $V_{GL_AC1B}$, during the respective periods in which the AC voltage lines $V_{GL_AC1}$, $V_{GL_AC1B}$ are in a HIGH voltage state, an overlapping period in which each of the pair of AC voltage lines $V_{GL_AC1}$, $V_{GL_AC1B}$ assumes a HIGH voltage exists during some period after a voltage is changed from a LOW voltage to a HIGH voltage and some period immediately before a voltage is changed from a HIGH voltage to a LOW voltage.

Hereinafter, the change in voltages at the nodes N2A, N2B is explained in accordance with a change in voltages with time shown in FIG. 7A and FIG. 7B. The AC voltage line $V_{GL_AC1}$ assumes a HIGH voltage within the period P1B and hence, the transistor TA1 is turned on and, further, the AC voltage line $V_{GL_AC1B}$ assumes a LOW voltage and hence, the transistor TA2 is turned off, so that the node N2A is made conductive with the node N2. Further, the AC voltage line $V_{GL_AC1}$ assumes a HIGH voltage within the period P1B and hence, the transistor TA4 is turned on and, further, the AC voltage line $V_{GL_AC1B}$ assumes a LOW voltage and hence, the transistor TA3 is turned off, and the node N2B is held at a LOW voltage.

At the time $t_1$, a voltage of the AC voltage line $V_{GL_AC1B}$ is changed from a LOW voltage to a HIGH voltage. Due to such a voltage change, the transistor TA3 is turned on, and the node N2B and the node N2 are made conductive with each other. Further, the AC voltage line $V_{GL_AC1B}$ is changed to a HIGH voltage and hence, a voltage of the node N2B is changed from a LOW voltage to a HIGH voltage. Due to such two points, the node N2B is also changed to a HIGH voltage in the same manner as the node N2. Then, the node N2 is made conductive with both of the node N2A and the node N2B.

At the time $t_2$, a voltage of the AC voltage line $V_{GL_AC1}$ is changed from a HIGH voltage to a LOW voltage. Due to such a voltage change, the transistor TA1 is turned off, and the conduction between the node N2A and the node N2 is eliminated. Further, the AC voltage line $V_{GL_AC1}$ is changed to a LOW voltage and hence, a voltage of the node N2A is changed from a HIGH voltage to a LOW voltage.

As described above, when the AC voltage line $V_{GL_AC1}$ assumes a HIGH voltage, the node N2A is made conductive with the node N2 thus assuming a HIGH voltage in response to a signal LOW period, and the transistors T2, T6 are turned on. Here, the AC voltage line $V_{GL_AC2}$ which has a phase opposite to the phase of the AC voltage line $V_{GL_AC1}$ assumes a LOW voltage and hence, the transistors T2, T6 respectively apply a LOW voltage of the AC voltage line $V_{GL_AC2}$ to the node N1 and the output terminal OUT. Further, when the AC voltage line $V_{GL_AC1}$ assumes a LOW voltage, the node N2A and the node N2 are no more conductive with each other, so that the node N2A assumes a LOW voltage and hence, the transistors T2, T6 are turned off.

In the same manner as described above, when the AC voltage line $V_{GL_AC1B}$ assumes a HIGH voltage, the node N2B is made conductive with the node N2 thus assuming a HIGH voltage in response to a signal LOW period, and the transistors T2A, T6A are turned on. Here, the AC voltage line $V_{GL_AC2B}$ which has a phase opposite to the phase of the AC voltage line $V_{GL_AC1B}$ assumes a LOW voltage, and the transistors T2A, T6A respectively apply a LOW voltage of the AC voltage line $V_{GL_AC2B}$ to the node N1 and the output terminal OUT. Further, when the AC voltage line $V_{GL_AC1B}$ assumes a LOW voltage, the node N2B and the node N2 are no more conductive with each other, so that the node N2B assumes a LOW voltage, and the transistors T2A, T6A are turned off.

Using the transistors TA1, TA2, TA3 and TA4 which constitute control switching elements and the AC voltage lines $V_{GL_AC1}$, $V_{GL_AC1B}$, it is possible to control whether or not the node N2A and the node N2B are connected with the node N2. With respect to the node N2A which is held at LOW voltage when the node N2A is not made conductive with the node N2, when the node N2A is made conductive with the node N2, the node N2A is controlled such that a voltage of the node N2A is changed from a LOW voltage to a HIGH voltage. Accordingly, it is possible to suppress lowering of the voltage of the node N2 which occurs when the node N2 which is made conductive with the node N2B is also made conductive with the node N2A. The same goes for a case where the node N2B is made conductive with the node N2.

As described above, by allowing each of the LOW voltage applying switching circuit 11 and the node N1 LOW voltage supply circuit 13 to have a plurality of transistors, compared to a case where a HIGH voltage is originally applied to a gate electrode of one transistor for a long time, it is possible to allow a plurality of transistors to share the time within which a HIGH voltage should be applied to the gate electrode of the transistor. Due to such time sharing, the time which causes the degeneration of a switching element can be delayed or the lifetime of the switching element can be prolonged.

Further, in the basic circuit 113 according to this embodiment, the lowering of the voltage of the node N2 which occurs in switching the driving of a plurality of transistors can be suppressed. Accordingly, by providing a transistor T4A according to the invention to such a basic circuit 113, the advantageous effect that a voltage of the node N2 can be made stable can be further enhanced.

As has been described heretofore, in the basic circuit 113 according to the second embodiment, the invention is also applicable to a case where a plurality of switching elements are connected in parallel to the LOW voltage applying switching circuit 11 and the node N1 LOW voltage supply circuit 13 respectively. Here, although the explanation has been made with respect to a case where the basic clock signals have four phases, the invention is also applicable to a case where the basic clock signals have five or more phases.

Third Embodiment

A display device according to a third embodiment of the invention basically has the same configuration as the display device according to the second embodiment of the invention. A point which mainly makes the display device of this embodiment different from the display device according to the second embodiment lies in the configuration of the basic circuit 113 of the shift register circuit 112.

Figure 8:
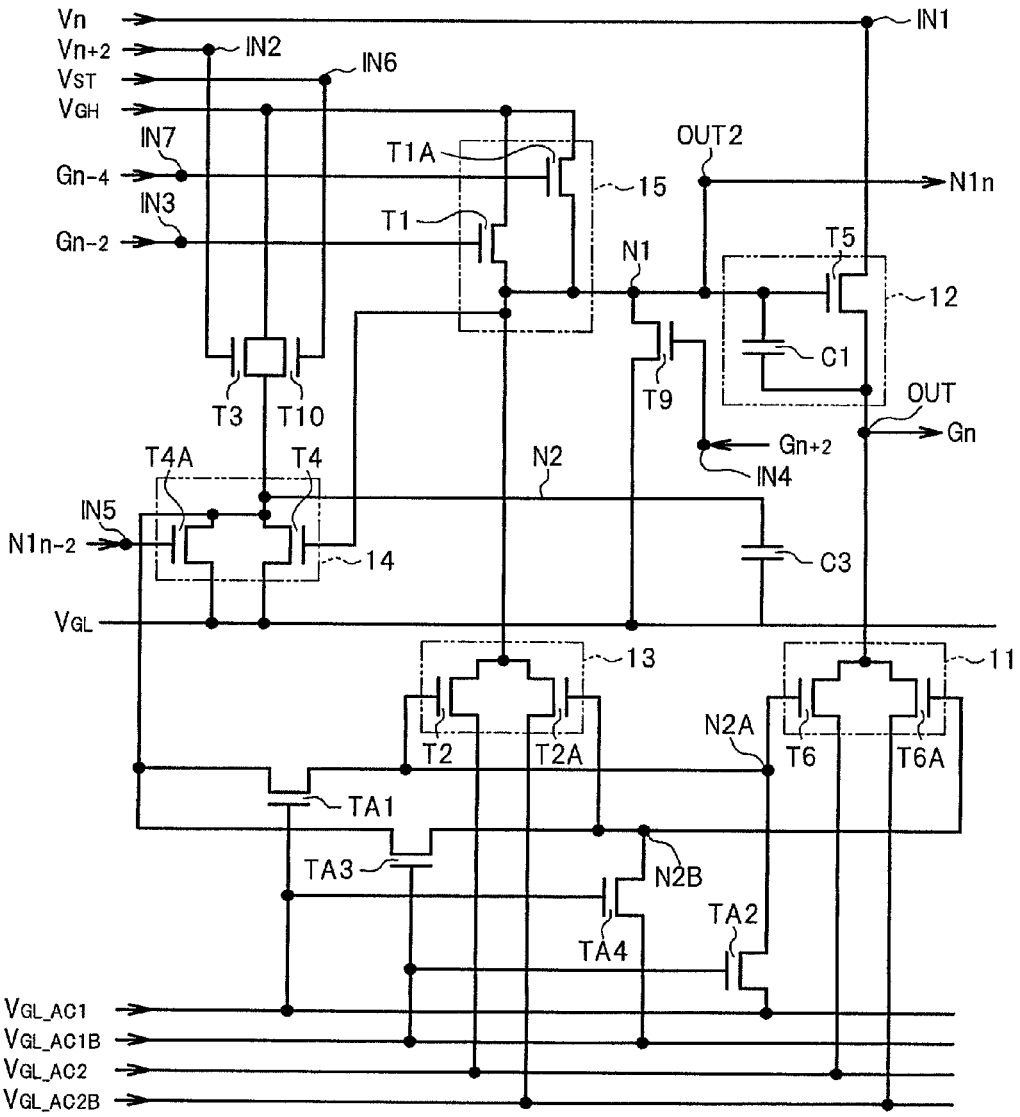
FIG. 8 is a circuit diagram of an n-th basic circuit according to a third embodiment of the invention.

FIG. 8 is a circuit diagram of an n-th basic circuit 113-*n* which is provided to a display device according to a third embodiment of the invention. As a point which mainly makes the n-th basic circuit 113-*n* of this embodiment different from the n-th basic circuit 113-*n* according to the second embodiment shown in FIG. 6, the node N1 HIGH voltage supply circuit 15 is further provided with a transistor T1A which is arranged parallel to the transistor T1. Further, a gate electrode of the transistor T1A is connected to an input terminal IN7, and a gate signal $G_{n-4}$ of an (n−4)th basic circuit 113-(*n*−4) is inputted to the input terminal IN7.

In the n-th basic circuit 113-*n*, within the period P1 shown in FIG. 5, the gate signal $G_{n-4}$ of the (n−4)th basic circuit 113-(*n*−4) assumes a HIGH voltage, so that the transistor T1A is turned on whereby a voltage of a node N1 is changed to a HIGH voltage.

Along with such a change, also in the (n−2)th basic circuit 113-(*n*−2), a voltage $N1_{n-2}$ of the node N1 assumes a HIGH voltage within a one-preceding period before the period P1 shown in FIG. 5. Accordingly, the transistor T4A of the n-th basic circuit 113-*n* is turned on, so that a voltage of the node N2 of the n-th basic circuit 113-*n* is changed to a LOW voltage. Here, to prevent timing when the transistor T4A is turned on from overlapping with timing when the transistor T3 is turned on in the basic circuit 113 according to this embodiment, it is preferable that basic clock signals have five or more phases.

In the basic circuit 113 according to this embodiment, by changing a voltage of the node N1 to a HIGH voltage from the period P1 which is a two-preceding period before the period P3 shown in FIG. 5 which is a signal HIGH period, a HIGH voltage of the basic clock signal $V_n$ can be outputted as a gate signal $G_n$ during a signal HIGH period more stably. Accordingly, an effect of suppressing noises from the gate signals can be further enhanced.

Here, in the basic circuit 113 shown in FIG. 4 and FIG. 6, two transistors which are arranged in parallel to each other are provided to the LOW voltage applying switching circuit 11 and the node N1 LOW voltage supply circuit 13 respectively. However, the number of transistors is not limited to two. The number of transistors may be increased to three, four or more. In this case, it is necessary to increase the number of AC voltage lines connected to the LOW voltage applying switching circuit 11 and the node N1 LOW voltage supply circuit 13 correspondingly to the respective nodes, like 3 pairs or 4 pairs of AC voltage lines. Due to such a configuration, it is possible to allow a further large number of transistors to share the time during which a HIGH voltage should be applied to one transistor and hence, time during which a HIGH voltage is applied to each transistor can be further decreased.

Further, the explanation of the shift register circuit 112 according to this embodiment has been made with respect to the case where a plurality of basic circuits 113 are arranged on both sides of the display region 120 as shown in FIG. 3. However, it is needless to say that the invention is applicable to, for example, a case where a plurality of basic circuits 113 are arranged on one side of the display region 120 or other cases.

Figure 9:
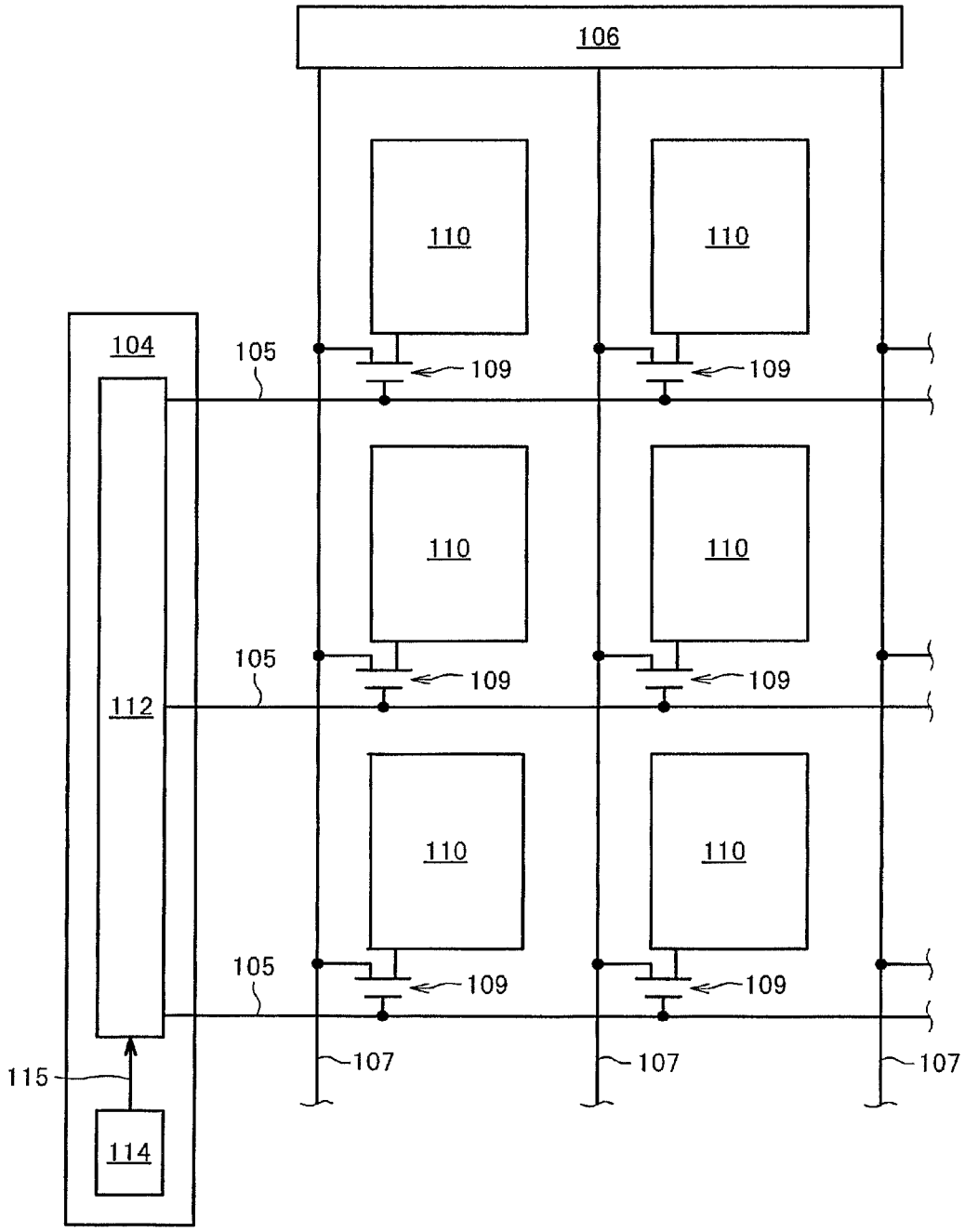
FIG. 9 is a conceptual view of an equivalent circuit of a TFT substrate provided to a liquid crystal display device according to another example of the embodiment of the invention.
Figure 10:
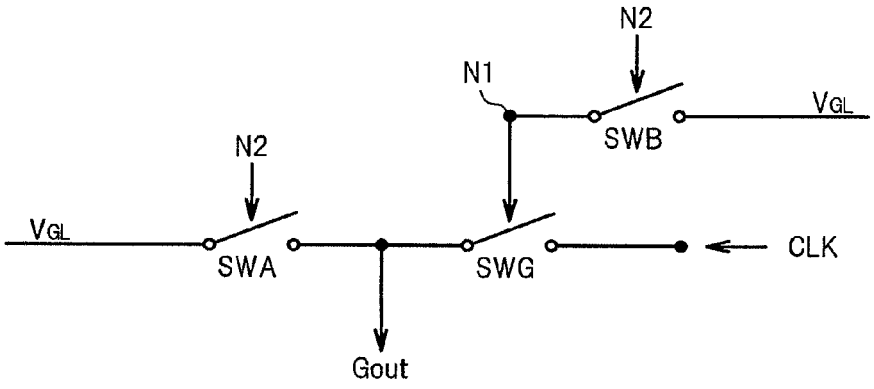
FIG. 10 is a schematic view showing the constitution of a basic circuit of a shift register circuit according to a related art.

Further, with respect to the display device according to the embodiments of the invention, the explanation has been made with respect to an IPS liquid crystal display device as shown in FIG. 2. However, the display device according to the invention may be a liquid crystal display device adopting other drive methods such as a VA (Vertically Aligned) liquid crystal display device or a TN (Twisted Nematic) liquid crystal display device. Further, the display device may be any other display device such as an organic EL display device. FIG. 9 is a conceptual view of an equivalent circuit of a TFT substrate 102 provided to a VA type or TN type liquid crystal display device. In the case of the VA or TN liquid crystal display device, common electrodes 111 are mounted on a filter substrate 101 which faces the TFT substrate 102 in an opposed manner.

While there have been described what are at present considered to be certain embodiments of the invention, it will be understood that various modifications may be made thereto, and it is intended that the appended claims cover all such modifications as fall within the true spirit and scope of the invention.

What is claimed is:

1. A display device comprising a plurality of gate signal lines and a gate signal line driving circuit, the gate signal line driving circuit comprising a plurality of basic circuits each of which is configured to output a gate signal having a HIGH voltage during a signal HIGH period and having a LOW voltage during a signal LOW period, which is a period other than the signal HIGH period, to the gate signal line, wherein the plurality of basic circuits includes a first basic circuit and a second basic circuit which is configured to assume a signal HIGH period before the signal HIGH period of the first basic circuit, and the first basic circuit and the second basic circuit respectively comprise:

a LOW voltage applying switching circuit configured to apply a LOW voltage to the gate signal line in response to the signal LOW period;

a HIGH voltage applying switching element configured to apply a HIGH voltage to the gate signal line in response to the signal HIGH period; and a LOW voltage applying OFF control element configured to apply an OFF voltage to a switching input terminal of a switch of the LOW voltage applying switching circuit such that the switch of the LOW voltage applying switching circuit is turned off in the signal HIGH period, wherein the LOW voltage applying OFF control element of the first basic circuit is turned on in response to an ON voltage applied to an internal voltage line, the internal voltage line is directly connected between the first basic circuit and the second basic circuit without directly connecting with the gate signal line, and wherein an OFF voltage for the LOW voltage applying OFF control element of the first basic circuit is applied to the internal voltage line and the LOW voltage applying OFF control element of the first basic circuit is turned off in response to the OFF voltage applied to the internal voltage line when the LOW voltage applying switching circuit of the second basic circuit outputs the LOW voltage to the gate signal line.

2. The display device according to claim 1, wherein the HIGH voltage applying switching element is turned on after the switch of the LOW voltage applying switching circuit is turned off.

3. The display device according to claim 1, wherein the LOW voltage applying switching circuit comprises a plurality of LOW voltage applying switching elements which are connected to the gate signal line parallel to each other.

4. The display device according to claim 1, wherein the HIGH voltage applying switching element is turned on in response to the ON voltage applied to the internal voltage line.

5. A display device comprising a plurality of gate signal lines and a gate signal line driving circuit, the gate signal line driving circuit comprising a plurality of basic circuits each of which is configured to output a HIGH voltage during a signal HIGH period and a LOW voltage during a signal LOW period to the gate signal line, wherein the plurality of basic circuits includes a first basic circuit, and a second basic circuit configured to output the HIGH voltage before the signal HIGH period of the first basic circuit, and the first basic circuit and the second basic circuit respectively comprise:

a LOW voltage applying switching circuit configured to apply the LOW voltage to the gate signal line in response to the signal LOW period;

a HIGH voltage applying switching element configured to apply the HIGH voltage to the gate signal line in response to the signal HIGH period; and a LOW voltage applying OFF control element configured to apply an OFF voltage to a switching input terminal of a switch of the LOW voltage applying switching circuit such that the switch of the LOW voltage applying switching circuit is turned off in the signal HIGH period, wherein the LOW voltage applying OFF control element of the first basic circuit is turned on in response to an ON voltage applied to an internal voltage line, the internal voltage line is directly connected between the first basic circuit and the second basic circuit without directly connecting with the gate signal line, and wherein an OFF voltage for the LOW voltage applying OFF control element of the first basic circuit is applied to the internal voltage line and the LOW voltage applying OFF control element of the first basic circuit is turned off in response to the OFF voltage applied to the internal voltage line when the LOW voltage applying switching circuit of the second basic circuit outputs the LOW voltage to the gate signal line.

6. The display device according to claim 5, wherein the HIGH voltage applying switching element is turned on after the switch of the LOW voltage applying switching circuit is turned off.

7. The display device according to claim 5, wherein the LOW voltage applying switching circuit comprises a plurality of LOW voltage applying switching elements which are connected to the gate signal line parallel to each other.

8. The display device according to claim 5, wherein the HIGH voltage applying switching element is turned on in response to the ON voltage applied to the internal voltage line.

* * * * *